United States Patent [19]

Regele

[11] 4,207,788

[45] Jun. 17, 1980

[54] APPARATUS FOR SEVERING AND STACKING PHOTOGRAPHIC PRINTS OR THE LIKE

[75] Inventor: Bruno Regele, Münich, Fed. Rep. of Germany

[73] Assignee: Agfa-Gevaert Aktiengesellschaft, Leverkusen, Fed. Rep. of Germany

[21] Appl. No.: 906,606

[22] Filed: May 16, 1978

Related U.S. Application Data

[63] Continuation of Ser. No. 782,339, Mar. 29, 1977, abandoned.

[30] Foreign Application Priority Data

Apr. 1, 1976 [DE] Fed. Rep. of Germany ..... 2614038

[51] Int. Cl.[2] ..... B65H 29/34

[52] U.S. Cl. ..... 83/89; 83/90; 83/94; 83/104; 83/156; 83/157; 271/192

[58] Field of Search ..... 83/82, 89, 90, 91, 94, 83/104, 156, 157, 102; 271/102, 192; 209/698

[56] References Cited

U.S. PATENT DOCUMENTS

| | | | |
|---|---|---|---|
| 872,383 | 12/1907 | Slick | 83/104 |
| 1,089,834 | 3/1914 | Goldberg | 83/157 |
| 3,205,794 | 9/1965 | Califano et al. | 271/192 X |
| 3,306,609 | 2/1967 | Beuck | 271/192 |
| 3,335,625 | 8/1967 | Kluth | 83/79 X |
| 4,002,560 | 1/1977 | Grantham | 271/192 X |

*Primary Examiner*—J. M. Meister

*Attorney, Agent, or Firm*—Peter K. Kontler

[57] ABSTRACT

Apparatus for subdividing a web of exposed and developed photographic paper into discrete prints has advancing rolls which move the web lengthwise in stepwise fashion to place successive frame lines into register with a severing device which is thereupon actuated to sever the web in order to separate the foremost print. Such print comes to rest on the wings of two turnable depositing devices which flank the path for the prints downstream of the severing device and are thereupon operated to rotate the wings in opposite directions so as to allow the print thereon to descend onto a composite stacking platform therebelow. The depositing devices have rotary hubs or plate-like orienting members which align the print on the wings with the prints of the stack therebelow. A hold-down plate is provided above the path for the prints to maintain the marginal portions of successive freshly separated prints in contact with the wings while the wings are held in the operative positions immediately below the path for the prints. The leaders and trailing ends of the webs are longer than the prints, and such sections of the webs are caused to enter the nip of auxiliary advancing rolls which transport them forwardly so that the longer sections cannot be transferred onto the stacking platform.

13 Claims, 2 Drawing Figures

CONTROL UNIT

APPARATUS FOR SEVERING AND STACKING PHOTOGRAPHIC PRINTS OR THE LIKE

This is a continuation of application Ser. No. 782,339, filed Mar. 29, 1977, now abandoned.

BACKGROUND OF THE INVENTION

The present invention relates to apparatus for severing webs or strips, especially webs or strips which consist of flexible material, and more particularly to improvements in apparatus which can be used with advantage for subdivision of webs of exposed and developed photographic material into discrete prints or groups of prints. Still more particularly, the invention relates to improvements in apparatus for severing and stacking prints or analogous sections of flexible web-like material.

Webs of exposed and developed photographic prints are customarily severed in an apparatus wherein the web is transported stepwise to place successive frame lines between neighboring prints into register with the mobile knife of a severing device. The web is held at a standstill while the mobile knife performs a working stroke to separate the foremost print from the next-following print or prints. The freshly separated prints are caused or allowed to descend into a collecting receptacle. As a rule, a first group of advancing rolls draws the web off a reel on which the web is stored in convoluted form, and a second group of advancing rolls is located immediately downstream of the severing station. The rolls of the second group are set in motion when the mobile knife of the severing device completes a working stroke to thereby advance the freshly severed print into register with the collecting receptacle. Thus, the rolls of the second group engage and support the foremost print of the web prior, during and subsequent to separation from the next-following print or prints. The prints tend to curl or flex because they are separated from a web which is normally stored in convoluted condition, and such tendency to curl prevents accurate stacking of severed prints in the collecting receptacle. The absence of accurate stacking prevents or interferes with automatic processing of prints which accumulate in the receptacle, e.g., with automatic transport to an assembly station where all prints belonging to a customer are introduced into an envelope or box, together with the corresponding exposed and developed film or film sections, for shipment to the dealer or directly to the customer.

Another drawback of presently known severing and stacking apparatus is that they cannot discriminate between prints and other sections of webs of exposed and developed photographic paper, e.g., between the prints and the leaders or trailing ends of the webs. Each print is provided with a marker (e.g., an indicium at the rear side thereof) which is detected by a scanning device, and such detection serves to arrest the web in an optimum position for separation of the foremost print from the next-following print or prints. The leaders and trailing ends of webs are not formed with markers and they are often much longer than the prints. Indiscriminate mixing of such leaders and trailing ends with satisfactory prints further interferes with orderly removal of prints from the collecting receptacle and with predictable processing of removed commodities. The relatively long leaders and/or trailing ends must be removed by hand. Relatively long sections of web material need not necessarily be located at the front or rear end of a web; thus, it can happen that useless sections of photographic paper are located midway between the ends of a web if two or more webs are spliced together end-to-end to form a composite web of substantial length.

OBJECTS AND SUMMARY OF THE INVENTION

An object of the invention is to provide a novel and improved apparatus for subdividing webs or strips of photographic paper or the like into sections (prints) of desired length and for automatically stacking satisfactory sections on top of each other in such a way that each upper section is in accurate register with the section therebelow.

Another object of the invention is to provide the apparatus with novel and improved means for automatically segregating unsatisfactory sections (especially sections which are too long) from satisfactory sections.

A further object of the invention is to provide the apparatus with novel and improved means for manipulating successively severed sections of a web immediately downstream of the severing station.

An additional object of the invention is to provide an apparatus which is capable of automatically accumulating successively severed satisfactory sections of a web or the like into a stack wherein the sections are arrayed in such a way that they can be readily manipulated e.g., transported, inserted, counted, etc.) by automatic devices.

The invention is embodied in an apparatus for subdividing a web into discrete sections of predetermined length, particularly for subdividing an exposed and developed strip of photographic material into prints. The apparatus comprises means for advancing a web in a predetermined direction along a predetermined path which is preferably horizontal or nearly horizontal, severing means adjacent a first portion of the path and being operable to cut transversely across the web and to thus separate the foremost section of the web, preferably during each interval of idleness of the advancing means, stacking means including a platform or the like located at a level below a second portion of the path which is disposed downstream of the first portion, as considered in the direction of advancement of the web, and means for transferring successive sections from the second portion of the path onto the stacking means.

The transferring means preferably comprises two discrete depositing devices which flank the second portion of the path and each of which includes at least one wing, vane or an analogous carrier movable between a first position in which the carriers support a section in the second portion of the path and at least one second position in which the section is free to descend or is postively transferred onto the stacking means. The carriers are preferably turnable (either indexible in a single direction or rotatable back and forth) between their first and second positions.

The novel features which are considered as characteristic of the invention are set forth in particular in the appended claims. The improved apparatus itself, however, both as to its construction and its mode of operation, together with additional features and advantages thereof, will be best understood upon perusal of the following detailed description of certain specific embodiments with reference to the accompanying drawing.

DESCRIPTION OF THE PREFERRED EMBODIMENTS

Figures 1, 2:
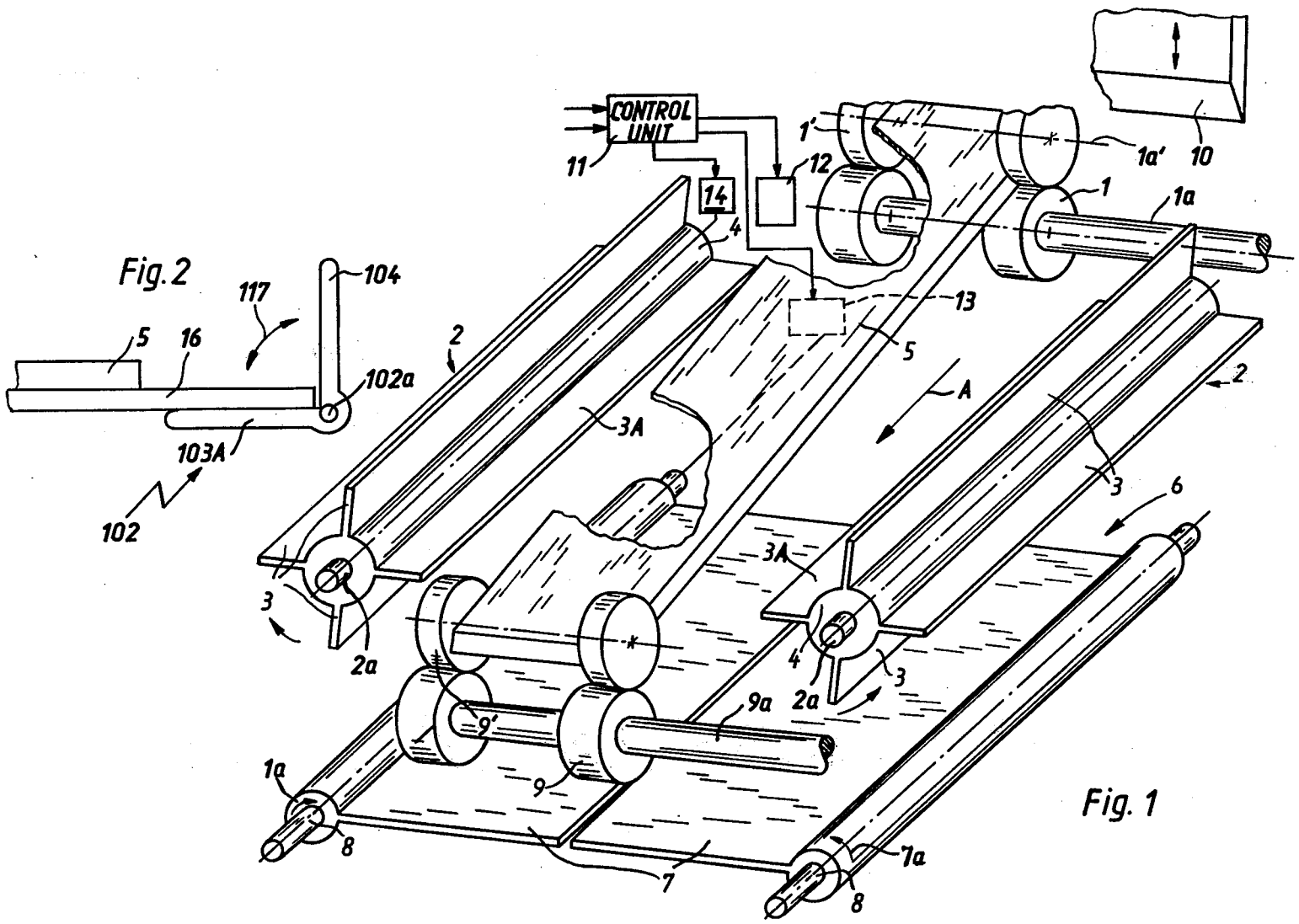
FIG. 1 is a fragmentary partly schematic perspective view of an apparatus which embodies one form of the invention.
FIG. 2 illustrates a portion of a modified apparatus.

Referring to FIG. 1, there is shown an apparatus for severing and stacking discrete prints of photographic paper. The apparatus comprises a pair of coaxial advancing rolls 1 which are mounted on a shaft 1*a* and are intermittently driven to advance the leader of a web or strip of photographic paper (not shown) in the direction indicated by arrow A. The rolls 1 are located immediately downstream of a severing station including a mobile knife 10 and a stationary knife (not shown). When the knife 10 is to perform a working stroke (downwardly, as viewed in FIG. 1), the advancing rolls 1 are at a standstill and engage the rear portion of the foremost print which is about to be separated from the next-following print. When the knife 10 completes a working stroke and returns to the retracted position of FIG. 1, the rolls 1 are set in motion and advance the freshly separated print to a level above a stacking platform 6 including two coplanar panels 7 which are mounted on turnable shafts 8 and normally assume the operative positions shown in FIG. 1. When the platform 6 accumulates a stack of prints (preferably a group or set of prints belonging to a customer), the panels 7 are pivoted in opposite directions (as indicated by the arrows 7*a*) to allow the accumulated stack to descent by gravity onto a conveyor or into a receptacle therebelow (not shown). The panels 7 thereupon return to the illustrated operative positions so that the platform 6 can begin with the accumulation of a fresh stack of superimposed prints.

In order to insure an accurately reproducible forward transport of the web and of discrete prints, the advancing rolls 1 preferably cooperate with advancing rolls 1′ which are mounted on a shaft 1*a*′. The shaft 1*a*′ is biased downwardly toward the shaft 1*a* so that the peripheral surfaces of upper rolls 1′ tend to engage the peripheral surfaces of the rolls 1 therebelow, i.e., the print in the horizontal path between the upper and lower rolls 1′ and 1 can be transported without any or with negligible slippage.

The apparatus further comrpises a control unit or synchronizing unit 11 which transmits signals to intermittently operated drive means 12 for the shaft 1*a* and to reversible drive means 13 for the shafts 8. The two shafts 8 are preferably coupled to each other by a gear train or the like so that the right-hand shaft 8 turns counterclockwise when the left-hand shaft 8 turns clockwise, and vice versa. The control unit 11 receives signals from a detector (not shown) which monitors the rear sides of prints and causes the unit 11 to arrest the drive means 12 whenever the frame line between the foremost print and the next-following print is in exact register with the cutting edge of the mobile knife 10. The unit 11 thereupon starts the drive means 12 with a preselected delay which suffices to allow the knife 10 to return to the raised position of FIG. 1; the drive 12 causes the freshly severed print to advance beyond the nip of the rolls 1 and 1′ and to come to rest on the adjacent preferably horizontal wings of carriers 3 of two rotary depositing or transferring devices 2 which flank the path for the prints at a level above the stacking platform 6. The path for the web and prints of photographic paper is preferably horizontal or nearly horizontal.

The wings or carriers 3 of the depositing devices 2 extend radially from the respective cylindrical hubs 4 which are mounted on and rotatable (indexible) by supporting shaft 2*a*. The left-hand shaft 2*a* of FIG. 1 receives motion from a drive means 14 which is controlled by the unit 11, and the right-hand shaft 2*a* is coupled to the left-hand shafts 2*a* by means of a gear train or the like so that the devices 2 are indexed in opposite directions, always through 90 degrees. The shortest distance between the hubs 4 equals or only negligibly exceeds the width of a print so that, when a freshly severed print enters the space between the adjacent wings 3 (denoted by the reference characters 3A), its marginal portions rest on the upper sides of the wings 3A and its longitudinally extending edge faces abut the respective hubs 4. Such hubs can be said to constitute a means for orienting the prints prior to transfer onto the platform 6. When the rolls 1 are arrested, i.e., when a freshly severed print has been advanced beyond the nip of the rolls 1 and 1′ and rests solely on the wings or carriers 3A, the drive means 14 rotates the supporting shafts 2*a* through 90 degrees whereby the freshly severed print descends onto the panels 7 therebelow and the next-following wings 3 come to a halt in the positions previously occupied by the wings 3A. Such next-following wings 3 are then ready to support the next print and to transfer the print onto the preceding print on the panels 7 as soon as the drive means 14 receives a fresh signal from the control unit 11.

In order to prevent buckling or other deformation of the prints which rest on the wings 3 of the depositing devices 2, the apparatus preferably comprises a plate-like hold-down device 5 which is located immediately above the level of the wings 3 flanking the path for the prints above the platform 6. It will be noted that the axes of the shafts 2*a* are parallel to the direction indicated by the arrow A and normal to the axes of the shafts 1*a* and 1*a*′. The rear portion of the hold-down device 5 preferably extends rearwardly into and beyond the space between the rolls 1 and 1′ and all the way to the severing station. This insures that the leader of the next-following print readily finds its way into the path below the hold-down device 5 when the rearmost advancing rolls (not shown in FIG. 1 but preferably corresponding to the rolls 1 and 1′) are set in motion to draw the web off a supply reel or the like, not shown. The control unit 11 or another control means sets the rearmost rolls in motion as soon as the knife 10 reassumes the raised position of FIG. 1 so that the foremost print of the web can advance into the nip of the rolls 1 and 1′ which are then driven to move the frame line between the two foremost prints of the web into register with the knife 10.

The apparatus preferably further comprises additional or auxiliary rolls 9 and 9′ which are mounted downstream of the depositing devices 2, as considered in the direction indicated by arrow A, and serve to engage and remove the leaders and trailing ends of successive webs, i.e., those sections of the webs which do not carry markers and do not constitute prints. As a rule, the leaders and trailing ends of the webs are longer than the prints so that the front portions af such relatively long web sections are held in the nip of the rolls 9 and 9′ and cannot descend onto the platform 6. The shat 9*a* for the rolls 9 can be driven at all times so that these rolls automatically advance the relatively long web sections beyond the platform 6 and allow or cause such long web sections to descend into a collecting receptacle, not shown.

The operation:

The rolls 1 and the preceding or rearmost rolls are set in motion in response to a signal from the control unit 11 so that they advance the web from the reel (not shown) and all the way to a position in which the frame line between the two foremost prints (or the front edge of the foremost print of a series of prints) is located in the path of movement of the cutting edge of the knife 10. As mentioned above, the control unit 11 receives signals from a detector which monitors the markers associated with successive prints. Stoppage of the rolls 1 and 1' is immediately followed by actuation of the severing means, i.e., the knife 10 descends and severs the web transversely across the foremost frame line, in front of the foremost print or behind the rearmost print of a series, as the case may be. When the knife 10 returns to the raised position of FIG. 1, the rolls 1 are set in motion again to advance the freshly separated print to a position above the platform 6 whereby such print comes to rest on the wings 3A and is held against buckling or other deformation by the underside of the hold-down device 5. The hubs 4 of the depositing devices 2 insure that the print on the wings 3A is in exact register with the print therebelow (on the panels 7) because the shortest distance between the hubs 4 immediately above the wings 3A equals or negligibly exceeds the width of a print.

The shafts 2*a* are set in motion as soon as the separated foremost print comes to rest solely on the wings 3A, and the devices 2 turn through 90 degrees (in opposite directions) to transfer the print onto the panels 7 or onto the uppermost print on the platform 6. At the same time, the next wings 3 assume the positions previously occupied by the wings 3A, and the control unit 11 starts the rearmost rolls and the rolls 1 to advance the next (still unseparated) print beyond the severing station. The web is then arrested and the knife 10 performs a workings stroke to sever the web across the frame line between the two foremost prints.

The panels 7 are pivoted to discharge the accumulated stack of prints when the aforementioned detector or an additional detector transmits a signal which causes the control unit 11 to actuate the reversible drive means 14. Such signal is produced in response to detection of a marker or indicium which designates the last print of a series, e.g., the last print of a customer order or the last print of the web.

Any relatively long sections of the web, i.e., those sections which are long enough to enter the nip of the rolls 9 and 9', cannot descend onto the platform 6; they are automatically entrained by the rolls 9 and 9' to enter the aforementioned receptacle or to be desposited onto a conveyor which transports the relatively long web sections to a waste collector or to another destination.

An advantage of indexible depositing devices 2 is that successive prints are more or less positively transferred onto the panels 7 or onto the uppermost print of a stack on the platform 6, and also that the next wings 3 automatically assume optimum positions with respect to the path of prints downstream of the advancing rolls 1 as soon as the transfer of the preceding print onto the stacking platform 6 is completed.

The distance between the nips of the rolls 1, 1' and the nips of the rolls 9, 9' exceeds the length of a satisfactory print so that the rolls 9, 9' cannot engage and entrain any satisfactory prints; this results in automatic segregation of unsatisfactory web sections from satisfactory web sections (prints).

FIG. 2 shows a portion of a modified apparatus wherein each of the two depositing or transferring devices 102 (only one shown) comprises a single carrier or wing 103A and an upwardly extending orienting or aligning member 104. A portion of a print which rests on the wing 103A is shown at 16. The supporting shaft 102*a* of the illustrated depositing device 102 is turnable back and forth through 90 degrees in directions indicated by the arrow 117. When a print 16 rests solely on the wings 103A, the devices 102 are caused to turn through 90 degrees (the illustrated device 102 turns anticlockwise, as viewed in FIG. 2) to deposit the print 16 onto the panels (not shown) or onto the uppermost print of the stack therebelow. The respective drive means thereupon rotates the devices 102 in the opposite directions so that the wings 103A reassume their first or operative positions. The marginal portions of a print 16 which rests on the wings 103A abut against or are close to the adjacent sides of the lower portions of the respective orienting members 104. This insures accurate stacking of prints 16 on the platform.

Depositing devices of the type shown in FIG. 2 can be used in relatively slow apparatus wherein the intervals between successive severing operations are long enough to allow for rotation of each shaft 102*a* in opposite directions.

It is further clear that each of the devices 2 of FIG. 1 can be provided with a single carrier or with two, three, five or more carriers; the respective drive means 13 is then adjusted to index the shafts 2*a* through 360°, 180°, 120°, 72°, etc.

Still further, the hubs 4 need not serve for lateral guidance or orientation of prints on the wings 3A. For example, the apparatus of FIG. 1 may be provided with two sets of pushers which flank the sides of a print on the wings 3A and perform a working stroke before the shafts 2*a* are rotated so as to insure that the print is properly centered on the wings 3A prior to descending onto the platform 6 or onto the uppermost print of the stack therebelow.

It is also possible to replace the depositing devices 2 of FIG. 1 with endless belts or chains which carry outwardly extending rungs or steps on which the prints 16 come to rest. The conveyors must be mounted in such a way that their rungs or steps are nearest to each other when they are adjacent the path for a freshly separated print and that they thereupon move away from each other while transporting the print toward the platform 6 therebelow so that the rungs are disengaged from the print not later than when the latter reaches the panels 7 or the uppermost print of the stack therebelow.

An important advantage of the improved apparatus is that it can convert a web of coherent sections into a stack of sections wherein successive sections are in accurate register with each other. Another advantage of the improved apparatus is that it can automatically segregate unsatisfactory sections (i.e., the leaders and trailing ends of webs of photographic paper or the like if the satisfactory sections are discrete prints) from satisfactory sections and does not permit the unsatisfactory sections to reach the stacking zone for acceptable sections. The stacks which accumulate on the platform 6 can be readily transported and/or otherwise processed by automatic means, or are in an optimum condition for manual or automatic insertion into envelopes, boxes or other types of containers. The distance between the nips of rolls 1, 1' and 9, 9' is preferably selected in such a way that the nip of the rolls 9, 9' receives the leader of the shortest unsatisfactory section of a web, as long as such unsatisfactory section is longer than a satisfactory section.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the claims.

What is claimed is:

1. Apparatus for subdividing a web into a succession of discrete shorter first sheet-like sections of predetermined uniform length and longer second sheet-like sections, particularly for subdividing an exposed and developed flexible strip of photographic material into discrete prints which constitute said first sections and strip portions which are to be segregated from prints and are longer than the prints and constitute said second sections, comprising means for advancing a web lengthwise in a predetermined direction along a predetermined path; severing means adjacent a first portion of said path and operable to cut transversely across the web to subdivide the latter into said first and second sections by separating the foremost sheet-like section from the next-following sheet-like section of the web, particularly during each interval of idleness of said advancing means; means for orderly stacking of said first sections, said stacking means being located at a level below a second portion of said path which is disposed downstream of said first portion, as considered in said direction; means for transferring successive first sections of uniform predetermined length from said second portion of said path onto said stacking means; and auxiliary advancing means located downstream of said second portion of said path for transporting the longer second sections beyond said second portion of said path in order to segregate sections whose length exceeds a maximum permissible length and retain sections of uniform predetermined length for stacking purpose, each of said advancing means comprising at least two rolls one of which is located above and the other of which is located below the respective portion of said path to positively engage and entrain the first and second sections into and to positively engage and entrain the second sections beyond said second portion of said path.

2. Apparatus as defined in claim 1, further comprising means for synchronizing the operation of said severing, advancing and transferring means.

3. Apparatus for subdividing a web into a succession of discrete shorter first sections of predetermined length and longer second sections, particularly for subdividing an exposed and developed flexible strip of photographic material into discrete prints which constitute said first sections and strip portions which are to be segregated from prints and constitute said second sections, comprising means for advancing the web lengthwise in a predetermined direction along a predetermined path; severing means adjacent a first portion of said path and length and longer second sections, particularly for subdividing an exposed and developed flexible strip of photographic material into discrete prints which constitute said first sections and strip portions which are to be segregated from prints and constitute said second sections, comprising means for advancing the web lengthwise in a predetermined direction along a predetermined path; servering means adjacent a first portion of said path and operable to cut transversely across the web to subdivide the latter into said first and second sections by separating the foremost section from the next-following section of the web, particularly during each interval of idleness of said advancing means; stacking means located at a level below a second portion of said path which is disposed downstream of said first portion, as considered in said direction, said stacking means comprising two pivotable panels; means for transferring successive first sections from said second portion of said path onto said stacking means; means for pivoting said panels between operative positions in which said panels support the lowermost first section of a stack of first sections thereon and inoperative positions in which said panels allow the stack to descend by gravity; and auxiliary advancing means located downstream of said second portion of said path for transporting second sections beyond said second portion of said path, each of said advancing means comprising at least two rolls one of which is located above and the other of which is located below the respective portion of said path to positively engage and entrain the first sections into said second portion and to positively engage and entrain the second sections beyond said second portion of said path.

4. Apparatus as defined in claim 3, wherein each of said depositing devices further comprises an orienting portion against which the respective marginal portion of a section in said second portion of said path abuts in the first positions of said carriers.

5. Apparatus as defined in claim 4, further comprising drive means for simultaneously moving said carriers from said first positions.

6. Apparatus as defined in claim 3, wherein said carriers are rotatable between said first and second positions and each of said depositing devices further comprises means for rotatably supporting said carriers, said supporting means defining axes which are substantially parallel to said direction.

7. Apparatus as defined in claim 6, further comprising drive means for rotating said carriers in opposite directions.

8. Apparatus as defined in claim 3, wherein each of said depositing devices further comprises a rotary support having an axis which is substantially parallel to said direction and a plurality of carriers provided on and extending substantially radially of the respective support, and further comprising drive means for indexing said supports in opposite directions so as to move successive carriers of each of said devices to said first positions.

9. Apparatus as defined in claim 8, wherein each of said depositing devices comprises four equidistant carriers and said drive means comprises means for indexing said supports through substantially 90 degrees.

10. Apparatus as defined in claim 3, further comprising a hold-down device located above said second portion of said path and having means for maintaining the marginal portions of a section in said second portion of said path in contact with the respective carriers while such carriers dwell in said first positions thereof.

11. Apparatus for subdividing a web into a succession of discrete shorter first sections of predetermined length and longer second sections, particularly for subdividing an exposed and developed flexible strip of photographic material into discrete prints which constitute said first sections and strip portions which are to be segregated from prints and constitute said second sections, comprising means for advancing the web lengthwise in a predetermined direction along a predetermined path; severing means adjacent a first portion of said path and operable to cut transversely across the web to subdivide the latter into said first and second sections by separating the foremost section from the next-following section of the web, particularly during each interval of idleness of said advancing means; stacking means located at a level below a second portion of said path which is operable to cut transversely across the web to subdivide the latter into said first and second sections by separating the foremost section from the next-following section of the web, particularly during each interval of idleness of said advancing means; stacking means located at a level below a second portion of said path which is disposed downstream of said first portion, as considered in said direction; means for transferring successive first sections from said second portion of said path onto said stacking means, said transferring means comprising two discrete depositing devices flanking said second portion of said path and each including at least one carrier movable between a first position in which said carriers support a first section in said second portion of said path and at least one second position in which the first section is free to come to rest on said stacking means; and auxiliary advancing means located downstream of said second portion of said path for transporting second sections beyond said second portion of said path, each of said advancing means comprising at least two rolls one of which is located above and the other of which is located below the respective portion of said path to positively engage and entrain the first and second sections into and to positively engage and entrain the second sections beyond said second portion of said path.

12. Apparatus for subdividing a web into a succession of discrete shorter first sections of predetermined disposed downstream of said first portion, as considered in said direction; means for transferring successive first sections from said second portion of said path onto said stacking means; a hold-down device located above said second portion of said path and having means for maintaining successive sections in said second portion of said path in engagement with said transferring means prior to operation of said transferring means; and auxiliary advancing means located downstream of said second portion of said path for transporting second sections beyond said second portion of said path, each of said advancing means comprising at least two rolls one of which is located above and the other of which is located below the respective portion of said path to positively engage and entrain the first and second sections into and to positively engage and entrain the second sections beyond said second portion of said path.

13. Apparatus as defined in claim 12, wherein said panels are substantially coplanar and substantially horizontal in said operative positions and extend substantially vertically downwardly in said inoperative positions thereof.

* * * * *